United States Patent [19]

Zhenjun et al.

[11] Patent Number: 4,719,535

[45] Date of Patent: Jan. 12, 1988

[54] AIR-IONIZING AND DEOZONIZING ELECTRODE

[75] Inventors: Huang Zhenjun; Wang Jianzhen, both of Suzhou, China

[73] Assignee: Suzhou Medical College, Suzhou, China

[21] Appl. No.: 840,673

[22] Filed: Mar. 18, 1986

[30] Foreign Application Priority Data

Apr. 1, 1985 [CN] China ..... 85102037

[51] Int. Cl.[4] ..... H05F 3/06

[52] U.S. Cl. ..... 361/232; 250/324

[58] Field of Search ..... 361/230, 231, 232; 55/120; 204/164; 250/324, 325, 326

[56] References Cited

U.S. PATENT DOCUMENTS 3,873,835 3/1975 Ignatjev ..... 361/230 X
4,064,548 12/1977 Best et al. ..... 55/120 X

FOREIGN PATENT DOCUMENTS 5580289 12/1978 China .
5514378 8/1980 China .
0048102 3/1982 European Pat. Off. .
2466886 4/1981 France ..... 361/232
2060427 5/1981 United Kingdom .
2088141 6/1982 United Kingdom .
2090547 7/1982 United Kingdom .
2093638A 9/1982 United Kingdom .

OTHER PUBLICATIONS

U.S. Popular Science, "Miracle Fuzz", 1980, No. 5, p. 7.
U.S. Popular Electronics, 1980, No. 4, p. 61.

*Primary Examiner*—L. T. Hix
*Assistant Examiner*—Brian W. Brown
*Attorney, Agent, or Firm*—Ladas & Parry

[57] ABSTRACT

An air-ionizing and deozonizing electrode block is fixed at the center of an insulating shell. The electrode block is made of a material containing manganese dioxide or copper oxide. The electrode block has many uniformly distributed perforations parallel to the axis of the insulating shell. Each perforation contains a conductive needle with its end bent 90° and fixed on the rear of the electrode block by conductive material. The point of the conductive needle in the central perforation of the electrode block projects from the front surface of the deozonizing block; the rest are within their perforation. The electrode block both generates negative ions in high concentration and clears ozone when high voltage of negative DC 10 KV-100 KV is applied.

4 Claims, 2 Drawing Figures

AIR-IONIZING AND DEOZONIZING ELECTRODE

The present invention relates to air-ionizing equipment.

In electric climatology, there are many air-ionizing methods. The one which produces a high concentration negative ions by artificial negative corona discharge is the simplest and most economical, but at the same time, produces a great deal of ozone which is harmful to health. Previous equipment for this method used a single electrode discharge of 6000 v so that, although the number of negative ions beneficial to health produced was low, the amount of ozone also was low.

In recent decades, many countries have been studying equipment which both increases the negative ion concentration and decreases the ozone concentration, such as carbon-fiber corona discharge equipment described in the following patent applications: U.S. Pat. No. 3,873,835 (3.1975), U.S. Pat. No. 4,064,548 (12.1977), J5758169, GB2093638 (9.1982), and EP48102 (3.1982). However, such equipment only decreases the ozone to some extent. GB2090547 (7. 1982) and DE3143978 (6. 1982) patent publications report on natural or artificial fiber-discharging equipment, but give no details about its technical specifications and technology. J5580289 and J55143788 patent publications report a method in which a corona needle is heated to 300°–400° C. to resolve the ozone. But the electric cost of equipment therefor was rather great and, with the temperature increase, the number of positive ions would increase and the number of negative ions would decrease substantially.

There are many kinds of material for resolving ozone, such as Polonium, Lead Oxide, Calcium Oxide, manganese Dioxide, Copper oxide. However, if they are simply applied to air-ionizing methods, the methods will produce neither ozone nor negative ions.

The object of the present invention is to provide an air-ionizing and deozonizing electrode which both produces a high concentration of negative ions with a negative high-voltage coronal discharge and clears of the produced ozone. Without an electric fan and its noise, it should jet the negative ions automatically.

The present invention is based on the principle of negative high voltage corona discharge. A cylindrical deozonizing electrode block with perforation is made of a material containing manganese dioxide or copper oxide and fixed inside a cylindrical or trumpet-shaped insulating shell. The perforations are parallel to shell and uniformly distributed on said electrode block. A conductive needle is fixed along the axis of each perforation. The end of each conductive needle is bent 90° and respectively fixed at the rear of the block by a conductive material. Only the point of the conductive needle in the central perforation of the block projects from the front surface of the electrode block; all the rest are within the perforations. The conductive needles are connected to a high voltage power supply by a high tension lead wire to the rear of the deozonizing electrode block. When the negative voltage of the power supply is DC 10 KV–100 KV, the point of each conductive needle jets negative ions in high concentration from the front of the deozonizing electrode block. The amount of ozone produced by the conductive needles themselves is very little, and with the affect of the deozonizing material of the electrode block, the ozone is cleared further. Thereby, a high concentration of negative ions clear of ozone is produced by the high negative voltage discharge.

In the Figures, (1) is an insulating shell, (2) is a deozonizing electrode block, (3*a*) are short conductive needles. (3*b*) is a long conductive needle, (4) is the high tension lead wire connected to the block and (5) are the perforations.

Figure 1:
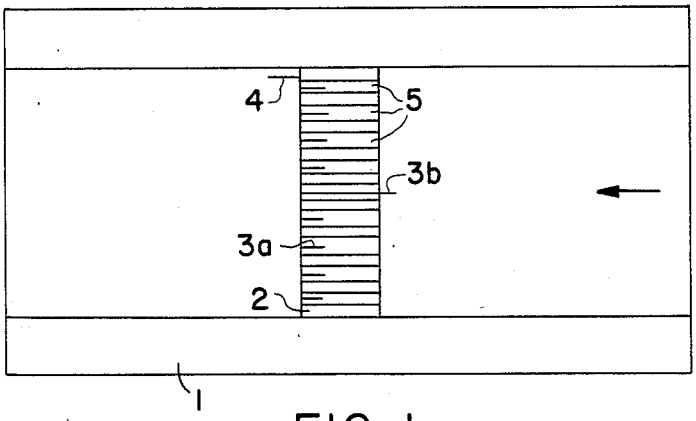
FIG. 1 is an illustration of the air-ionizing and deozonizing electrode.
Figure 2:
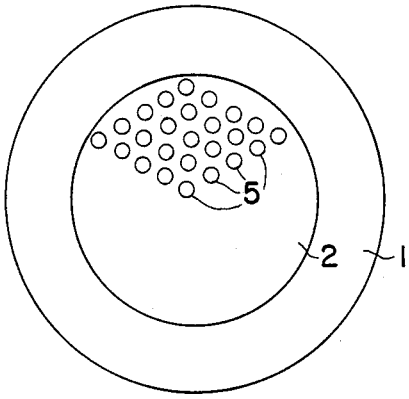
FIG. 2 is a profile of the air-ionizing and deozonizing electrode.

FIG. 1 shows that the deozonizing electrode block (2) is fixed at the center of insulating shell (1), and that there are many perforations (5) distributed uniformly on said block and parallel to the axis of the block. In each perforation there is a conductive needle (3*a*, 3*b*) along its axis. In the central perforation, there is a long conductive needle (3*b*) which projects from the front surface of the deozoning electrode block (2), while the rest of the needles (3*a*) are short and within the perforations. Each conductive needles end is bent 90° and fixed at the rear of the deozonizing electrode block by conductive material. When the high voltage lead wire (4) is connected to the high voltage power supply and a high DC voltage of 10 KV–100 KV is switched on, a high concentration negative ions is jetted from the point of each of the conductive needles.

In a practical embodiment of this invention, the deozonizing electrode block made of a material containing manganese dioxide or copper oxide has a diameter of 40 mm and a height of 10 mm. The electrode block is fixed at the center of the insulating shell, which has an internal diameter of 40 mm, an outer diameter 60 mm and a length 140 mm. The perforations, each with an aperture of 2.5 mm, are uniformly distributed on the deozonizing electrode block, and the distance between their centers is 6 mm. There is a conductive needle fixed in each perforation and it is firmly connected to the high tension lead wire. Thus an air-ionizing and deozonizing electrode is made.

The main technical performances of the electrode according to this invention are as follows: At a distance 50 mm from the instrument panel the negative ion concentration is higher than 2.5 million/cm$^{o}$ and the ozone concentration is lower than 5 ppb. It can automatically so jet the negative ions without an electric fan and noise. In this invention several deozonizing electrodes may use a common power supply. According to need, the electrode may desk-type, wall-type, pendent-type, console-type or so on.

The invention may have widespread use in the field of curing and preventing sicknesses, and health care. It is also useful for places where clearing ozone or increasing the negative ion concentration is required.

What is claimed is:

1. An electrode for producing a high concentration of negative ions in air and, at the same time, clearing ozone therefrom, comprising:

a cylindric insulating shell (1);

a cylindric electrode block (2) inside the insulating shell, the electrode block having perforations (5) therethrough between front and rear surfaces of the electrode block, one of the perforations being central of the electrode block;

a conductive needle (3*a*, 3*b*) in each perforation, one end of each needle being pointed and the other end of each needle being bent about 90° to the axis of the needle and fixed to the rear surface of the electrode block for the needle to project along the axis of one of the perforations, the point of the needle in the central perforation so projecting from the front surface of the electrode block, the needle in each other perforation so projecting only within the perforation in which it projects; and a high tension lead wire (4) connected to the electrode block.

2. The said electrode according to claim 1, wherein the said perforations are uniformly distributed on the surface of the cylindrical block and parallel to the axis thereof.

3. The said electrode according to claim 1, wherein the said electrode block is made of a material containing manganese dioxide or copper oxide for deozonizing.

4. The said electrode according to claim 2, wherein the electrode block is made of a material containing manganese dioxide or copper oxide for deozonizing.

* * * * *